US012276488B1

(12) United States Patent
Panchal et al.

(10) Patent No.: US 12,276,488 B1
(45) Date of Patent: Apr. 15, 2025

(54) MULTI-COMPARTMENT MORTAR INCREMENT CONTAINER

(71) Applicants: U.S. Gov. as Represented by the Sec. of the Army, Dover, NJ (US); U.S. Gov. as Represented by the Sec. of the Army, Dover, NJ (US)

(72) Inventors: Viral Panchal, Parlin, NJ (US); Linjie Zhu, Livingston, NJ (US); Fei Shen, Shanghai (CN); Mingwan Young, Basking Ridge, NJ (US); Jacqueline A. Longcore, Andover, NJ (US); Dylan McHugh, Dover, NJ (US); Chandrark Patel, Belle Mead, NJ (US); Elbert Caravaca, Budd Lake, NJ (US); Mohamed Elalem, Carteret, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 18/470,856

(22) Filed: Sep. 20, 2023

Related U.S. Application Data

(60) Provisional application No. 63/376,695, filed on Sep. 22, 2022.

(51) Int. Cl.
*F42B 5/192* (2006.01)

(52) U.S. Cl.
CPC ..... *F42B 5/192* (2013.01)

(58) Field of Classification Search
CPC .. F42B 5/18; F42B 5/181; F42B 5/182; F42B 5/188; F42B 5/192
USPC ..... 102/431, 432, 434, 282, 700
See application file for complete search history.

(56) References Cited

U.S. PATENT DOCUMENTS

| | | | | |
|---|---|---|---|---|
| 3,124,070 | A * | 3/1964 | Jasse | F42B 30/12 102/373 |
| 4,711,180 | A * | 12/1987 | Smolnik | F42B 8/10 102/498 |
| 4,898,097 | A * | 2/1990 | Jordan | F42B 30/12 102/373 |
| 6,837,164 | B1 * | 1/2005 | Khanna | F42B 30/12 102/373 |
| 7,690,305 | B2 * | 4/2010 | Harjula | F42B 30/12 102/373 |
| 8,617,328 | B1 * | 12/2013 | Young | C06B 25/20 149/19.8 |
| 2005/0268806 | A1 * | 12/2005 | Harjula | F42B 30/12 102/291 |

* cited by examiner

*Primary Examiner* — John Cooper
(74) *Attorney, Agent, or Firm* — John P. DiScala

(57) ABSTRACT

A multi-compartment mortar increment container (MIC) enables burning of two propellants to broaden the pressure-time curve providing additional energy and force behind a mortar shell while maintaining allowable pressures. During the ballistic cycle, the mortar increment container burns allowing the faster propellant to mix with the slower propellant. The slower propellant will burn later in the ballistic cycle generating higher pressure behind the projectile leading to higher velocity.

16 Claims, 10 Drawing Sheets

MULTI-COMPARTMENT MORTAR INCREMENT CONTAINER

CROSS-REFERENCE TO RELATED APPLICATIONS

This application claims the benefit under 35 USC § 119(e) of U.S. provisional patent application 63/376,695 filed on Sep. 22, 2022.

STATEMENT OF GOVERNMENT INTEREST

The inventions described herein may be manufactured, used and licensed by or for the United States Government.

FIELD OF THE INVENTION

The invention relates in general to munitions and in particular to propelling charges for munitions.

BACKGROUND OF THE INVENTION

Mortar systems are used by infantry troops as indirect fire weapon to fire at different target ranges. Each mortar cartridge has a projectile with a fuze, obturating ring, fin assembly, ignition cartridge, and four propelling charges. A propelling charge is made up of an energetic propellant and mortar increment containers (MIC). The MIC is designed to house energetic propellants in a horseshoe-shaped container and is assembled around the fin assembly shaft. By increasing or decreasing the number of propelling charges that are attached to a mortar munition, the range of the mortar can be increased or decreased, respectively.

Militaries are constantly striving to extend range across all mortar systems, and more specifically on 120 mm mortar systems, using currently fielded weapon components. It is a challenge to meet this need for longer range while staying within the current weapon platform requirements. These requirements include but are not limited to the maximum allowable pressure, chamber volume, tube length, and projectile weight.

Propellant burning rate can be adjusted to achieve varying ballistic performance, and is accomplished primarily through formulation, geometry, charge design, and loading density. Utilizing a more progressive propellant that has a slower burn rate can provide more force behind the projectile over a longer duration effectively allowing for increased velocities. However, developing a progressive propellant to meet new requirements can be expensive and have its challenges interfacing with the current weapon components. For example, one issue is that while a progressive, slower burning propellant may have a lower peak pressure than faster burning propellants currently used, the faster burning propellant concentrates most of that pressure towards the breech side of the mortar weapon which is much stronger than the muzzle. The slower burning (progressive) propellant, while having the benefit of a lower peak pressure, will distribute the pressure more evenly across the length of the mortar barrel. Existing mortar system barrels are thinner and weaker at certain location of the barrel towards the muzzle and may not be able to withstand pressures generated by a more progressive propellant. Additionally, if the propellant is deterred too much, the propellant will not be consumed in time prior to the mortar munition exiting the weapon system. This is wasted chemical energy and potentially will induce a fire hazard or even an unsafe environment for the warfighter.

A need exists for a mortar increment container which both interfaces with currently fielded weapon systems and provides improved range.

SUMMARY OF INVENTION

One aspect of the invention is a multi-compartment mortar increment container. The multi-compartment mortar increment container includes a housing assembly and a divider. The divider defines a first compartment for housing a first propellant and a second compartment for housing a second propellant.

Another aspect of the invention is a multi-compartment mortar increment container comprising a foamed celluloid horseshoe-shaped housing assembly and a foamed celluloid divider. The housing assembly has a hollow interior and comprises a pair of corresponding slots on an upper interior surface and a lower interior surface. The foamed celluloid divider is positioned within the pair of the corresponding slots and defines a first compartment and a second compartment. The outer compartment houses a first propellant, and the inner compartment houses a second propellant. The first propellant has a slower burn rate than the second propellant.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
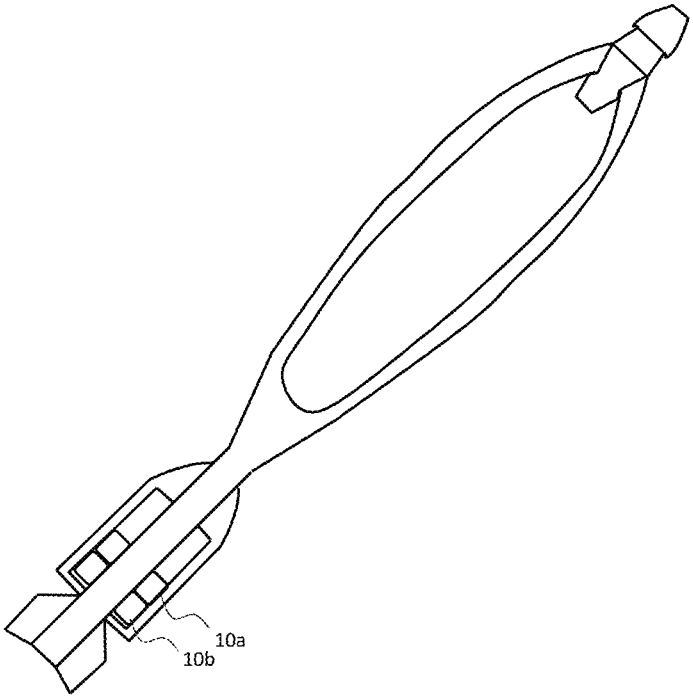
FIG. 1 is a cross-sectional view of a mortar munition, according to an illustrative embodiment.

A multi-compartment mortar increment container (MIC) includes multiple compartments for propellants within the container thereby allowing propellant blends of different progressivity, or burn rate, to be utilized within the multi-compartment MIC. The use of a two propellant blends inside a MIC allows for larger flexibility to adjust the propellant burning rate to extend the overall munitions range.

Energetic propellants of two different burning rates are loaded separately in two compartments of the MIC configuration and are kept separated within the container until use. This allows for more accurate control of the propellant charge weight. Propellants of different burning rates can be achieved through changes in formulation, grain shape, grain sizes, charge design and loading density. The use of multiple compartments helps to eliminate the issues of settling or segregation of one size and shape from the other during transport and storage. This could lead to improper ballistics if loaded into a single compartment MIC.

A multi-compartment MIC enables burning two propellants at different times, mostly in series, to broaden the pressure-time curve providing extra energy and force behind a mortar shell while maintaining allowable pressures. During the ballistic cycle, the mortar increment container burns allowing the faster propellant to mix with the slower propellant. The slower propellant will burn later in the ballistic cycle generating higher pressure for an extended period of time behind the projectile leading to higher velocity.

The multi-compartment MIC interfaces with existing mortar systems. The exterior profile of the multi-compartment MIC may be matched to existing MICs such as the M234A1 propelling charge. Further, the use of two blends of propellant allows for more force behind the projectile over a longer duration effectively allowing for increased velocities while maintaining gun pressure limits.

The multi-compartment MIC can be tailored by sheet thickness, sheet density and sheet material. For example, in one embodiment, the multi-compartment MIC can be made from foamed celluloid material. The placement of a sheet divider, made of foamed celluloid, can be adjusted according to the optimized propellant charge weight and burning rate requirements. In this embodiment, each of the individual dividers are to be made with foamed celluloid sheet material, so they burn cleanly upon ignition within the residence time without affecting other performance characteristics. In addition, foamed celluloid provides precision conversion capability, unparalleled part-to-part consistency without a need for 100% visual inspection (unlike felted fiber/wet mold process), very low reject rate, cost savings, and minimal change to current manufacturing operations.

The material of the multi-compartment MIC is not limited to foamed celluloid. The multi-compartment MIC may be made of any consumable or combustible material.

While the multi-compartment MIC is primarily described throughout this specification as containing two propellants with different progressivity or burn rate, the propellants may be tailored in different ways. The multi-compartment MIC can house energetic propellants of different burning rates, formulations, geometry, etc. allowing to optimize the charge weight and burning behavior, according to the targeted performance requirement.

FIG. 1 is a cross-sectional view of a mortar weapon cartridge, according to an illustrative embodiment. Each mortar cartridge has a projectile with a fuze, an obturating ring, fin assembly, ignition cartridge, and propelling charges 10*a, b*. The propelling charge is made up of a multi-compartment mortar increment containers (MIC) 10 and a first propellant and a second propellant housed within.

Figure 2:
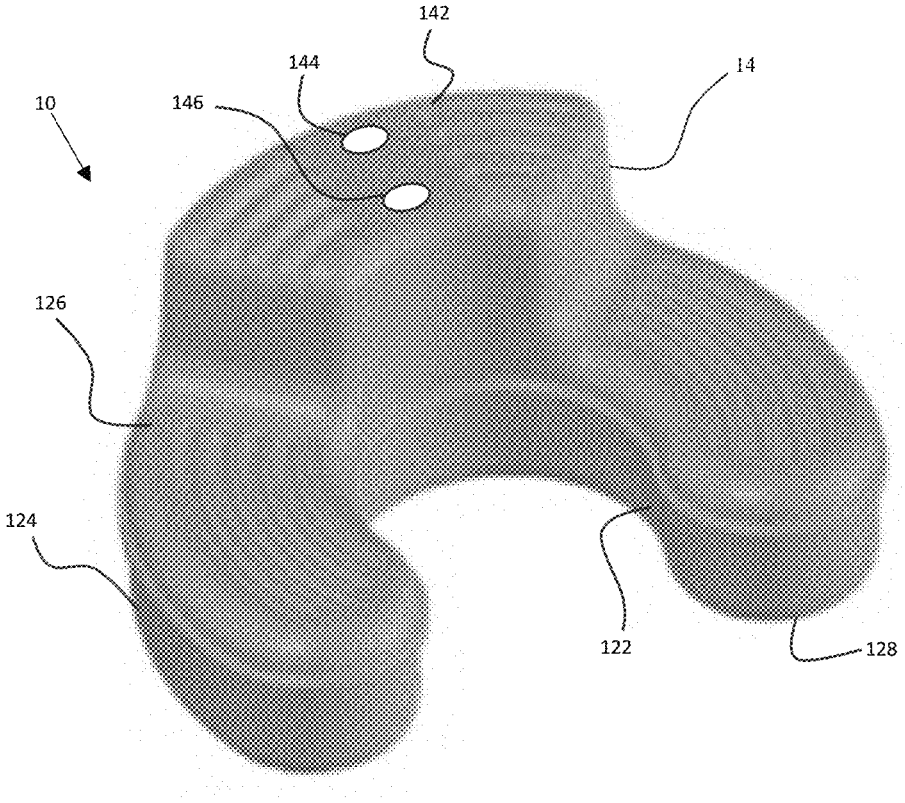
FIG. 2 is a multi-compartment mortar increment container, according to an illustrative embodiment.
Figure 3:
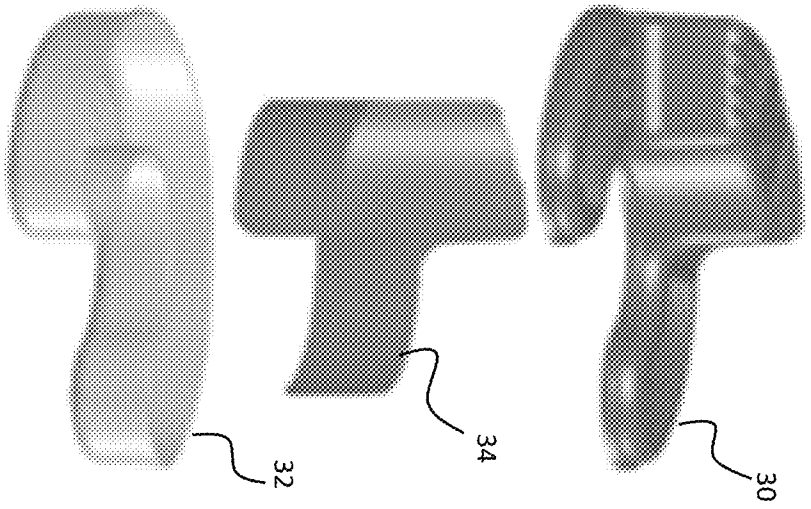
FIG. 3 is an exploded view of a multi-compartment mortar increment container, according to an illustrative embodiment.
Figure 4:
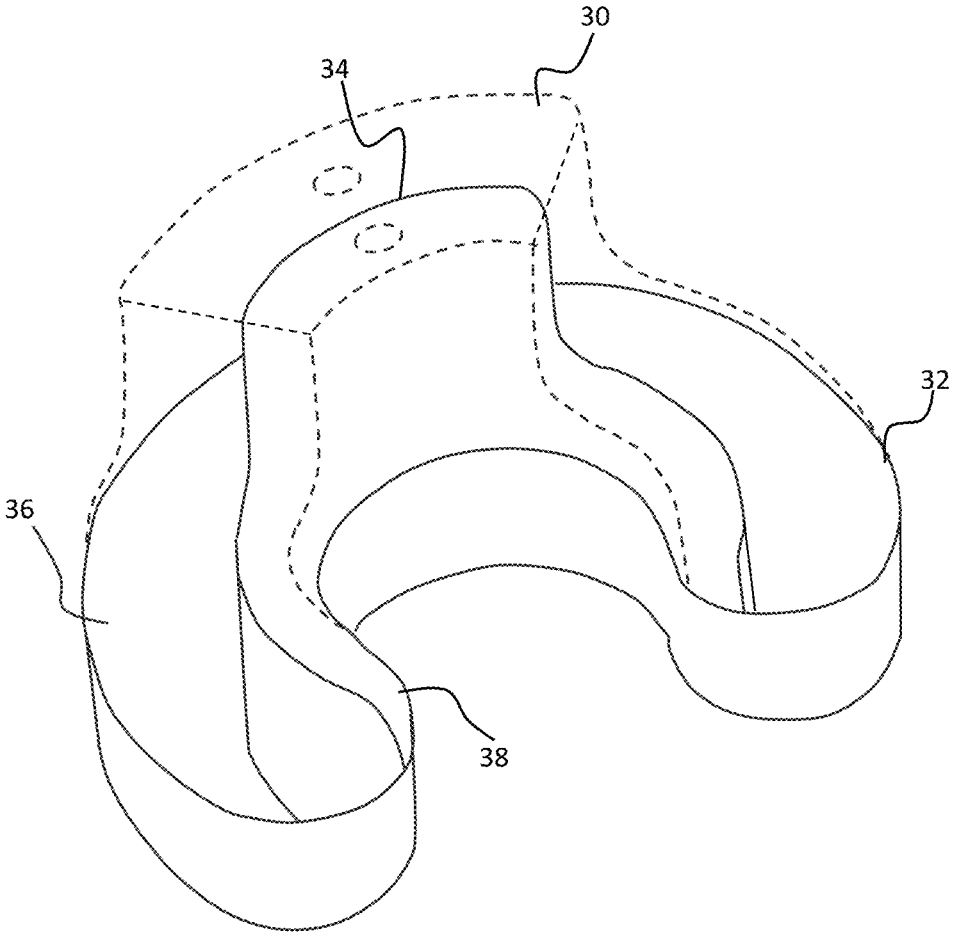
FIG. 4 is a multi-compartment mortar increment container with an upper component shown in transparency, according to an illustrative embodiment.

FIG. 2 is a multi-compartment mortar increment container, according to an illustrative embodiment. FIG. 3 is an exploded view of a multi-compartment mortar increment container, according to an illustrative embodiment. FIG. 4 is a multi-compartment mortar increment container with an upper component shown in transparency, according to an illustrative embodiment.

The multi-compartment MIC 10 is a horseshoe shaped housing having a hollow interior defining multiple compartments. The multi-compartment MIC 10 shown in FIGS. 2-4 has the same exterior profile as an M234A1 propelling charge. In the embodiment shown, the multi-compartment MIC 10 comprises a first compartment 36 and a second compartment 38. As described in further detail below, the multi-compartment MIC is not limited to two compartments and may include more than two compartments and/or various means of dividing these compartments.

The exterior surface of the multi-compartment MIC 10 comprises an interior arc 122, an exterior arc 124, a top surface 126 and a bottom surface 128. When employed on a mortar cartridge, the interior arc 124 is positioned proximate the tail.

A protrusion 14 extends from the top exterior surface 126 of the multi-compartment MIC 10. The top surface 142 of the protrusion 14 comprises a first through-hole 144 and a second through-hole 146 with the holes providing fill access to a first compartment 16 and a second compartment 18, respectively.

The multi-compartment MIC 10 is assembled from three components: an upper component 30, a lower component 32 and a divider 34. The upper component 30 and the lower component 32 are assembled to form the housing. The divider 34 is inserted between the upper component 30 and the lower component 32 to define the compartments within the multi-compartment MIC 10. The first compartment 36 and the second compartment 38, and therefore their contents, are kept separated from each other by the divider 34.

Figure 5:
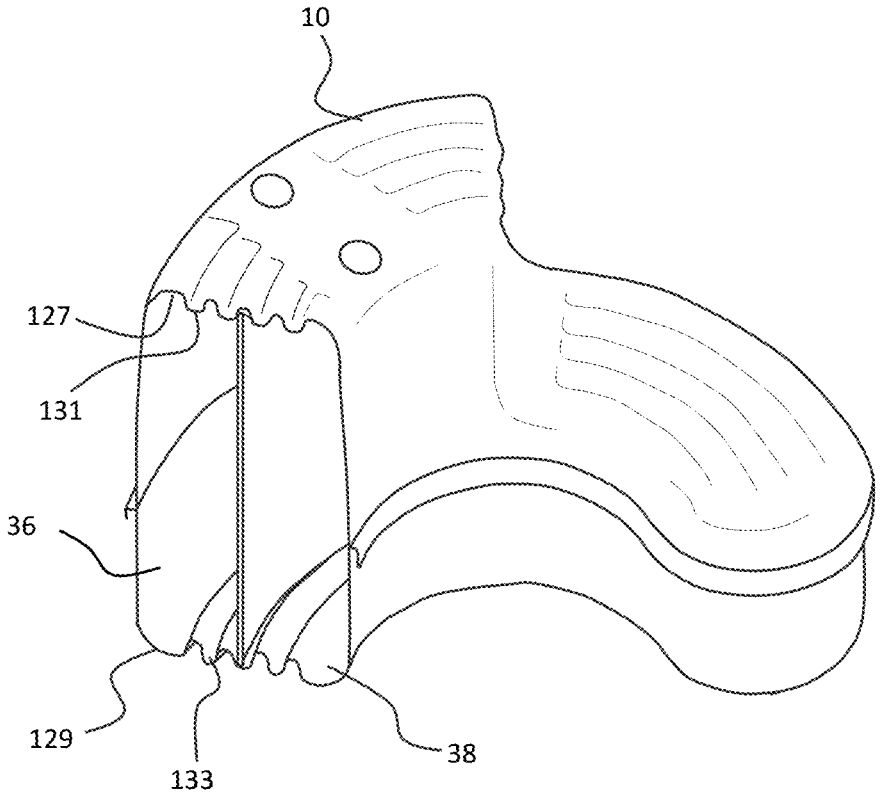
FIG. 5 is a partial cutaway view of a multi-compartment mortar increment container, according to an illustrative embodiment.

FIG. 5 is a partial cutaway view of a multi-compartment mortar increment container, according to an illustrative embodiment. The divider 34 is inserted into slots 131 defined by an interior upper surface 127 of the top component 32 and corresponding slots 133 defined by the interior bottom surface 129 of the bottom component 34. The interior upper surface 127 and interior bottom surface 129 comprise multiple corresponding slots 131, 133 which are diametrically opposed to each other. The divider 34 is inserted into two complimentary slots to divide the interior of the multi-compartment MIC 10 into two compartments. The first compartment 36 extends around the outer portion of the multi-compartment MIC 10 and the second compartment 38 extends around the inner portion of the multi-compartment MIC 10.

Each of the upper surface 127 and bottom surface 129 contains multiple slots and the volume of the compartments formed by the divider 34 can be tailored by selectively placing the divider 34 into one of these sets of slots. In the embodiment, the slots are formed from ridges in the multi-compartment MIC material. For example, in some applications it may be desirable to have a larger first compartment and a relatively smaller second compartment, or vice versa. In this way, the compartments can be tailored according to the optimized propellant charge weight and burning rate requirements.

Figure 6:
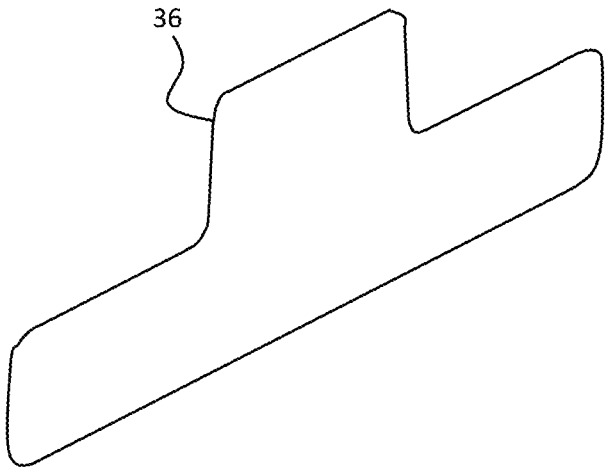
FIG. 6 is a stamped divider prior to forming, according to an illustrative embodiment.
Figure 7:
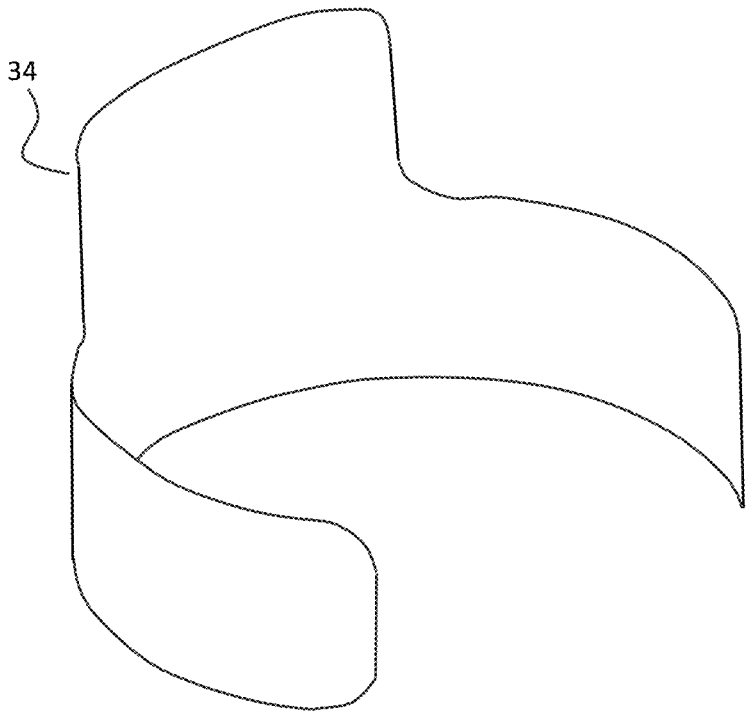
FIG. 7 is a divider formed into a curved shape, according to an illustrative embodiment.

FIG. 6 is a stamped divider prior to forming, according to an illustrative embodiment. FIG. 7 is a divider formed into a curved shape, according to an illustrative embodiment. Each component of the multi-compartment MIC 10 may be formed from a material which burns cleanly and within the time of the combustion event. In one embodiment, the multi-compartment MIC 10, including the divider 34, is made from foamed celluloid sheet material. Accordingly, the components burn cleanly upon ignition within the residence time without affecting other performance characteristics. In one embodiment, the divider 34 is precisely stamped from foamed celluloid sheet material. The stamped divider is then formed into the curved divider necessary to fit within the multi-compartment MIC housing.

In one embodiment in which the multi-compartment MIC is employed to increase the effective range of a mortar cartridge as compared to a mortar cartridge with a traditional propelling charge, the first compartment 36, or outer compartment, is filled with a propellant having a slower burn rate. The multi-compartment MIC 10 allows for the burning of two propellants at different times, mostly in series, to broaden the pressure-time curve and therefore provide extra energy/force behind the mortar shell at max allowable pressure. During the ballistic cycle, the mortar increment container will burn allowing the faster propellant to ignite/burn first and later mix with the slower propellant. Note: the slower burning propellant may ignite at the same time but due to its slower burning nature will not contribute to kinetic energy transfer to the projectile initially. The slower propellant will burn later in the ballistic cycle generating higher pressure behind the projectile leading to higher velocity.

In embodiments of the multi-compartment MIC, the two propellants are ignited at separate times and burn substantially in series; however, the multi-compartment MIC is not limited to this embodiment. In other embodiments, the propellants may ignite and burn at the same time, in series or some combination of the two. For example, geometry or material choice may influence the order of ignition and burning.

Figure 8:
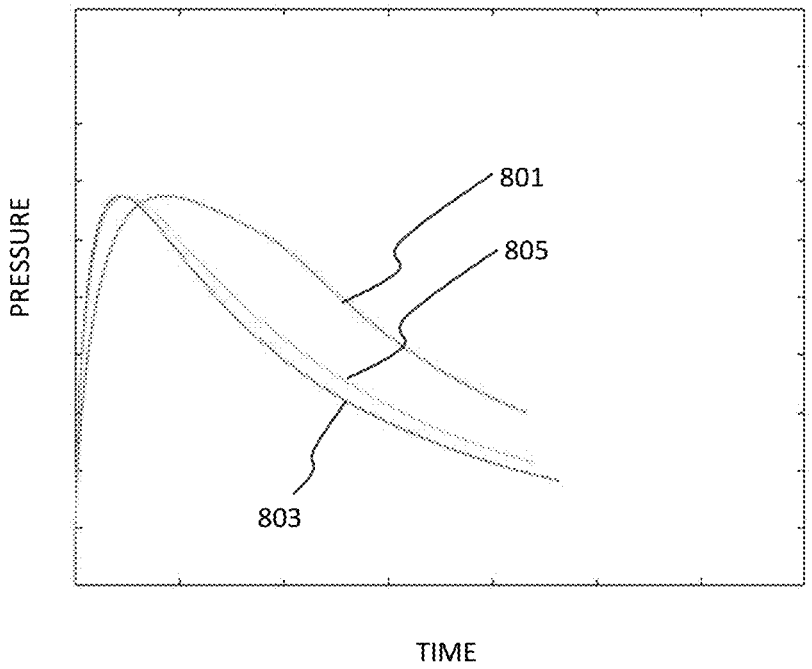
FIG. 8 is a graph plotting pressure verses time for a slow burning propellant, a fast-burning propellant and a blend of the slow burning propellant and fast burning propellant, according to an illustrative embodiment.

FIG. 8 is a graph plotting pressure verses time for a slow burning propellant, a fast burning propellant and a blend of the slow burning propellant and fast burning propellant, according to an illustrative embodiment. As shown in the graph, the plot 801 for the slow burning propellant has a larger area under the curve which translates to more energy provided by the propellant. However, the peak pressure of the slow burning propellant occurs later than the plot 803 for the fast burning propellant which may cause structural damage to existing weapon system barrels as margin of safety is reduced. The plot 805 of the blended propellant shows a peak pressure which is earlier in time than the peak of the plot 801 for the slow burning propellant and an area under the curve which is larger than for the plot 803 of the fast burning propellant.

Figure 9:
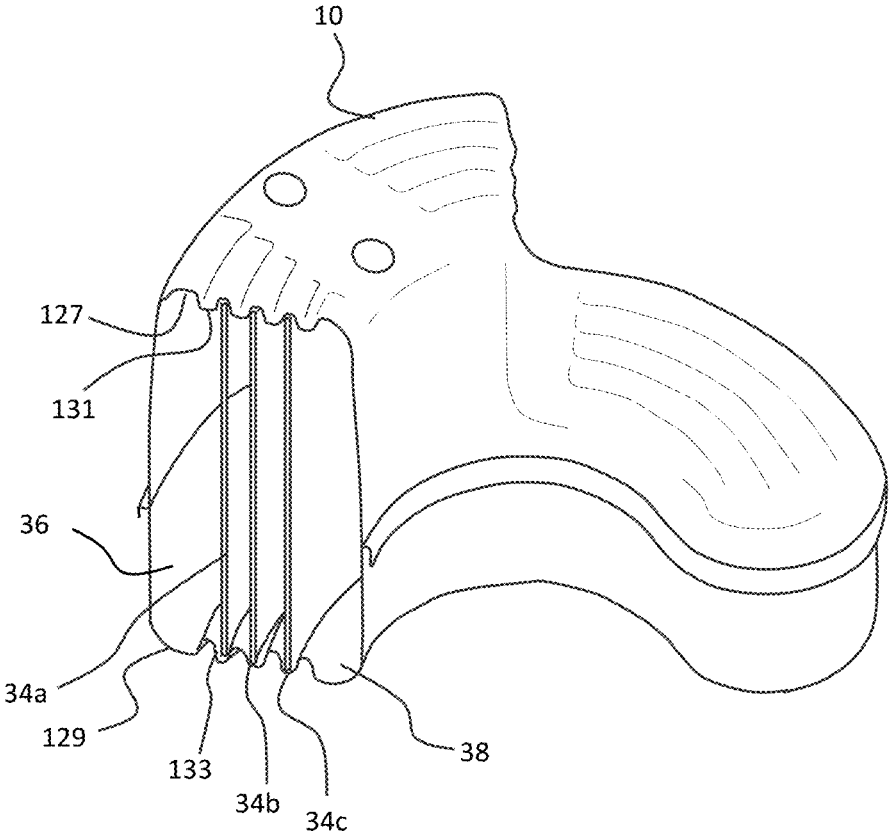
FIG. 9 is a partial cutaway view of a multi-compartment mortar increment container having multiple dividers, according to an illustrative embodiment.

FIG. 9 is a partial cutaway view of a multi-compartment mortar increment container having multiple dividers, according to an illustrative embodiment. In embodiments of the invention, it may be desirable to contain three or more separated propellant blends within a multi-compartment MIC 10. In these embodiments, the multi-compartment MIC 10 comprises a plurality of dividers 36.

Figure 10:
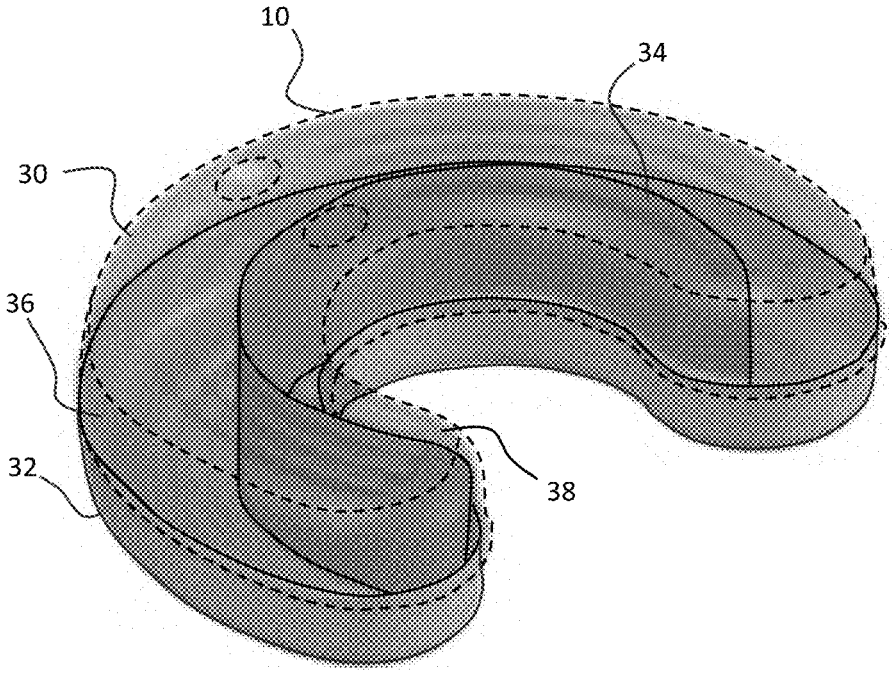
FIG. 10 is a multi-compartment mortar increment container, according to an illustrative embodiment.

FIG. 10 is a multi-compartment mortar increment container with a top component shown in transparency, according to an illustrative embodiment. In other embodiments, the exterior profile of the multi-compartment MIC 10 may be matched to existing MICs for other caliber mortar systems. The embodiment shown in FIG. 10, is a multi-compartment MIC for an 81 mm mortar system.

While the invention has been described with reference to certain embodiments, numerous changes, alterations and modifications to the described embodiments are possible without departing from the spirit and scope of the invention as defined in the appended claims, and equivalents thereof.

What is claimed is:

1. A multi-compartment mortar increment container comprising:

a housing assembly; and a divider within the housing wherein the divider defines a first compartment for housing a first propellant and a second compartment for housing a second propellant and wherein the first propellant and the second propellant have different burn rates.

2. The multi-compartment mortar increment container of claim 1 wherein the housing assembly and divider are made of a consumable material.

3. The multi-compartment mortar increment container of claim 2 wherein the housing assembly and divider are made of foamed celluloid.

4. The multi-compartment mortar increment container of claim 1 wherein the housing assembly is comprised of an upper housing and a lower housing and wherein the divider interfaces with features on an interior surface of the upper housing and an interior surface of the lower housing to define the first compartment and the second compartment.

5. The multi-compartment mortar increment container of claim 4 wherein the container is horseshoe-shaped and the divider is inserted into a slot defined by the interior surface of the lower housing and a slot defined by the interior surface of the upper housing such that it is aligned vertically in relation to the container.

6. The multi-compartment mortar increment container of claim 5 wherein the first compartment is an outer compartment positioned proximate an exterior curve of the container and the second compartment is an inner compartment positioned proximate an interior curve of the container.

7. The multi-compartment mortar increment container of claim 4 wherein the interior surface of the upper housing and the interior surface of the lower housing comprise a plurality of slots thereby allowing for a position of the divider to be configurable.

8. The multi-compartment mortar increment container of claim 4 further comprising a plurality of dividers defining a plurality of compartments greater than two.

9. The multi-compartment mortar increment container of claim 1 wherein container is horseshoe shaped and the first compartment is positioned proximate an exterior curve of the container and the second compartment is positioned proximate an interior curve of the container and wherein the first propellant has a slower burn rate than the second component.

10. The multi-compartment mortar increment container of claim 1 wherein an exterior profile of the multi-compartment mortar increment container is the same as an exterior profile of an M234A1 propelling charge.

11. The multi-compartment mortar increment container of claim 1 further comprising a first through hole and a second through hole in a top surface of the multi-compartment mortar increment container wherein said first hole provides access to the first compartment and said second hole provides access to the second compartment.

12. The multi-compartment mortar increment container of claim 1 wherein the first propellant and the second propellant have different formulations.

13. A multi-compartment mortar increment container comprising:

a foamed celluloid horseshoe-shaped housing assembly having a hollow interior and comprising a pair of corresponding slots on an upper interior surface and a lower interior surface;

a foamed celluloid divider positioned within the pair of the corresponding slots and defining an outer compartment for housing a first propellant and an inner compartment for housing a second propellant, said first propellant having a slower burn rate than the second propellant.

14. The multi-compartment mortar increment container of claim 13 wherein the interior surface of the upper housing and the interior surface of the lower housing comprise a plurality of slots thereby allowing for a position of the divider to be configurable.

15. The multi-compartment mortar increment container of claim 13 wherein an exterior profile of the multi-compartment mortar increment container is the same as an exterior profile of an M234A1 incrementing charge.

16. The multi-compartment mortar increment container of claim 13 further comprising a first through hole and a second through hole in a top surface of the multi-compartment mortar increment container wherein said first hole provides access to the first compartment and said second hole provides access to the second compartment.

* * * * *